US007991121B2

(12) United States Patent
Smith

(10) Patent No.: US 7,991,121 B2
(45) Date of Patent: Aug. 2, 2011

(54) FREQUENCY TUNED ANODE BEARING ASSEMBLY

(75) Inventor: Ricky Smith, Sandy, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 111 days.

(21) Appl. No.: 12/488,398

(22) Filed: Jun. 19, 2009

(65) Prior Publication Data

US 2010/0322385 A1 Dec. 23, 2010

(51) Int. Cl.
*H01J 35/00* (2006.01)

(52) U.S. Cl. ..... 378/132; 378/125; 378/121

(58) Field of Classification Search ..... 378/119–144
See application file for complete search history.

(56) References Cited

U.S. PATENT DOCUMENTS

| | | | | |
|---|---|---|---|---|
| 2,648,025 | A | 8/1953 | Agule | |
| 3,619,696 | A | 11/1971 | De Lucia | |
| 4,679,220 | A * | 7/1987 | Ono | 378/132 |

FOREIGN PATENT DOCUMENTS

| | | |
|---|---|---|
| EP | 0 189 297 | 7/1986 |
| WO | 2006/103006 | 10/2006 |
| WO | 2008/058267 | 5/2008 |

OTHER PUBLICATIONS

Extended European Search Report issued by the European Patent Office on Nov. 5, 2010 in connection with corresponding European Patent Application No. 10166468.8.

* cited by examiner

*Primary Examiner* — Courtney Thomas
(74) *Attorney, Agent, or Firm* — Maschoff Gilmore & Israelsen

(57) ABSTRACT

In one example embodiment, an x-ray tube comprises an anode configured to rotate at an operating frequency, and a bearing assembly configured to rotatably support the anode and tuned to a resonant frequency that is different than the operating frequency.

19 Claims, 8 Drawing Sheets

FREQUENCY TUNED ANODE BEARING ASSEMBLY

BACKGROUND OF THE INVENTION

1. The Field of the Invention

The present invention generally relates to rotating machinery. In particular, some example embodiments relate to an x-ray tube bearing assembly with a resonant frequency tuned to enable operation at one or more desired operating frequencies.

2. The Related Technology

X-ray producing devices are extremely valuable tools that are used in a wide variety of applications, both medical and industrial. For example, such equipment is commonly employed in areas such as medical diagnostic examination and therapeutic radiology, semiconductor manufacture and fabrication, and materials analysis.

Regardless of the applications in which they are employed, x-ray devices operate in similar fashion. In general, x-rays are produced when electrons are emitted, accelerated, and then impinged upon a material of a particular composition. This process typically takes place within an evacuated enclosure of an x-ray tube. Disposed within the evacuated enclosure is a cathode, or electron source, and an anode oriented to receive electrons emitted by the cathode. The anode can be stationary within the tube, or can be in the form of a rotating annular disk that is mounted to a rotor shaft which, in turn, is rotatably supported by a bearing assembly. The evacuated enclosure is typically contained within an outer housing, which also serves as a reservoir for a cooling fluid, such as dielectric oil, that serves both to cool the x-ray tube and to provide electrical isolation between the tube and the outer housing.

In operation, an electric current is supplied to a filament portion of the cathode, which causes a cloud of electrons to be emitted via a process known as thermionic emission. A high voltage potential is placed between the cathode and anode to cause the cloud of electrons to form a stream and accelerate toward a focal spot disposed on a target surface of the anode. Upon striking the target surface, some of the kinetic energy of the electrons is released in the form of electromagnetic radiation of very high frequency, i.e., x-rays. The specific frequency of the x-rays produced depends in large part on the type of material used to form the anode target surface. Target surface materials with high atomic numbers ("Z numbers") are typically employed. The target surface of the anode is oriented so that the x-rays are emitted as a beam through windows defined in the evacuated enclosure and the outer housing. The emitted x-ray beam is then directed toward an x-ray subject, such as a medical patient, so as to produce an x-ray image.

In x-ray devices that include a rotating anode, the intensity of the emitted x-ray beam depends in part on the rotational frequency of the anode, usually expressed in Hertz ("Hz"). To obtain high x-ray beam intensities required for certain applications, such as in high-speed CT scanners, the rotating anode may be required to operate at frequencies as high as 150 Hz or higher, for instance.

Regardless of the actual or desired operating frequency, all rotating anode designs are characterized by one or more resonant frequencies. Vibrations of the rotating anode caused by imbalances in the anode or other rotating components reaches a maximum when the anode is operated at or near a characteristic resonant frequency. Although rotating anodes may briefly rotate at a resonant frequency during acceleration to an operating frequency above or below the resonant frequency, maximized vibration levels at the resonant frequency prevent prolonged operation at the resonant frequency.

In the case of conventional x-ray devices, the characteristic resonant frequency of a rotating anode is measured after manufacture of the rotating anode and bearing assembly has been completed. Once the resonant frequency has been determined, the manufacturer typically specifies one or more permitted operating frequencies. A user is thus constrained to operate at the operating frequencies specified by the manufacturer without regard to the operating frequencies that may be desired by the user to achieve a particular x-ray beam intensity.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF SOME EXAMPLE EMBODIMENTS

In general, example embodiments of the invention relate to an x-ray tube with a tuned bearing assembly and/or tuned anode assembly.

In one example embodiment, an x-ray tube comprises a rotating anode configured to rotate at an operating frequency, and a bearing assembly configured to rotatably support the rotating anode and tuned to a resonant frequency that is different than the operating frequency.

In another example embodiment, an x-ray tube comprises an evacuated enclosure, an electron source disposed within the evacuated enclosure, and an anode assembly at least partially disposed in the evacuated enclosure. The anode assembly is tuned to a resonant frequency different than an operating frequency. The anode assembly includes an anode positioned to receive electrons emitted by the electron source, a bearing assembly rotatably supporting the anode, and a rotor sleeve to which the anode and a portion of the bearing assembly are coupled. The rotor sleeve is responsive to applied electromagnetic fields such that a rotation motion is imparted to the anode.

In yet another example embodiment, a method of manufacturing a bearing assembly comprises selecting a desired operating frequency for the bearing assembly and tuning the bearing assembly to a predetermined resonant frequency that does not materially impair operation of the bearing assembly at the desired operating frequency.

These and other aspects of example embodiments of the invention will become more fully apparent from the following description and appended claims.

BRIEF DESCRIPTION OF THE DRAWINGS

To further clarify various aspects of some embodiments of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF EXAMPLE EMBODIMENTS

Reference will now be made to the figures wherein like structures will be provided with like reference designations. It is understood that the figures are diagrammatic and schematic representations of some embodiments of the invention, and are not limiting of the present invention, nor are they necessarily drawn to scale.

FIGS. 1-6 disclose various aspects of some example embodiments of the invention. Embodiments of the x-ray tube may, among other things, help reduce vibrations caused by imbalanced rotating components of the x-ray tube by employing one or more rotating components tuned to a resonant frequency that does not conflict with a desired operating frequency. Note that the principles disclosed herein can also be applied to other x-ray tubes or devices, or any other rotating machinery, where imbalanced rotating components cause vibrations that can interfere with proper device operation.

I. Example Operating Environment

Figure 1:
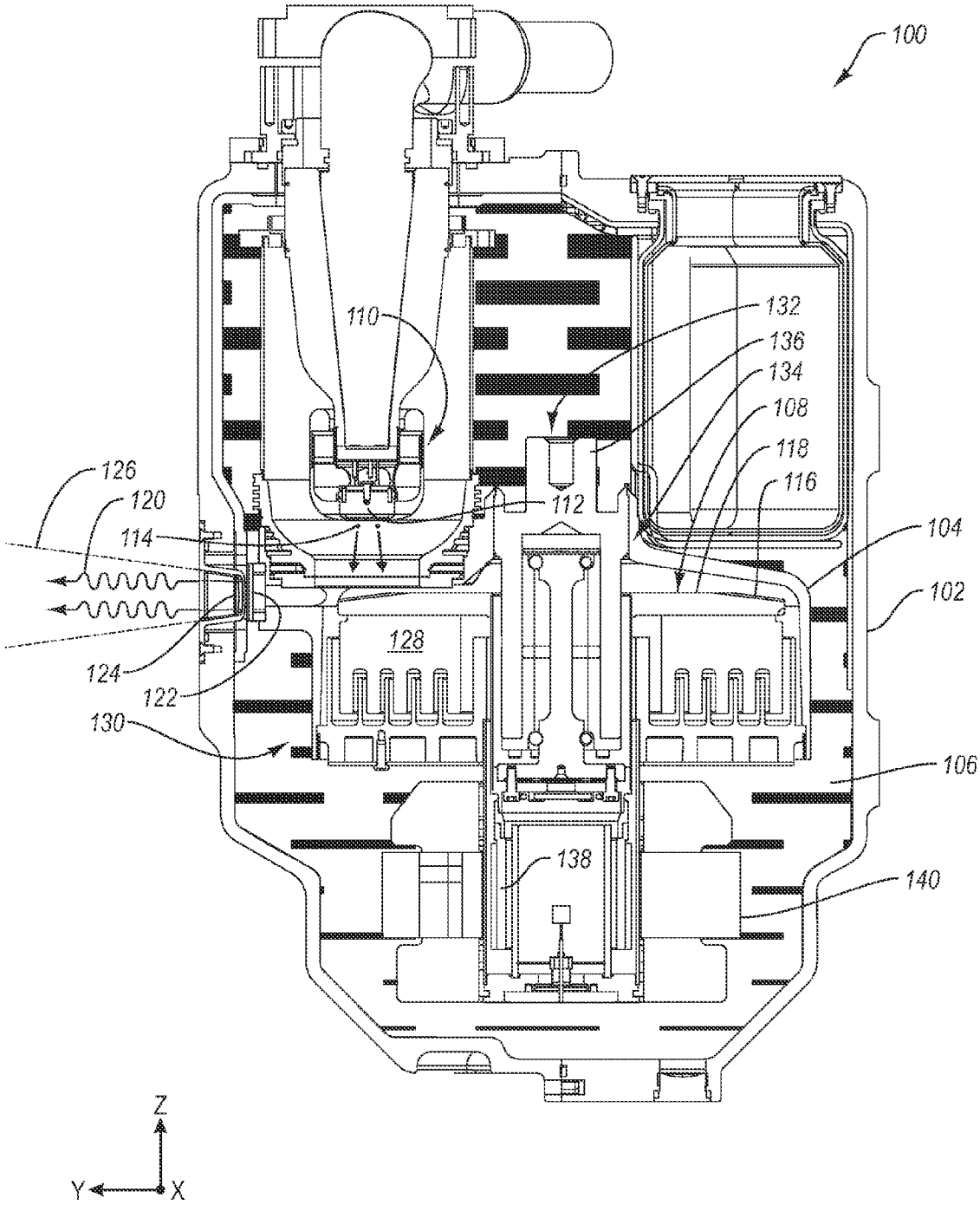
FIG. 1 is a simplified cross-sectional depiction of an x-ray device incorporating a tuned bearing assembly according to an embodiment of the invention.

Reference is first made to FIG. 1, which illustrates a simplified structure of a rotating anode-type x-ray tube, designated generally at 100. X-ray tube 100 includes an outer housing 102, within which is disposed an evacuated enclosure 104. A cooling fluid 106 is also disposed within the outer housing 102 and circulates around the evacuated enclosure 104 to assist in x-ray tube cooling and to provide electrical isolation between the evacuated enclosure 104 and the outer housing 102. In some embodiments, the cooling fluid 106 may comprise dielectric oil, which exhibits desirable thermal and electrical insulating properties for some applications, although cooling fluids other than dielectric oil can alternately or additionally be implemented in the x-ray tube 100.

Disposed within the evacuated enclosure 104 are an anode 108 and a cathode 110. The anode 108 is spaced apart from and oppositely disposed to the cathode 110, and may be at least partially composed of a thermally conductive material such as copper or a molybdenum alloy. The anode 108 and cathode 110 are connected in an electrical circuit that allows for the application of a high voltage potential between the anode 108 and the cathode 110. The cathode 110 includes a filament 112 that is connected to an appropriate power source and, during operation, an electrical current is passed through the filament 112 to cause electrons, designated at 114, to be emitted from the cathode 110 by thermionic emission. The application of a high voltage differential between the anode 108 and the cathode 110 then causes the electrons 114 to accelerate from the cathode filament 112 toward a focal track 116 that is positioned on a target surface 118 of the anode 108. The focal track 116 is typically composed of tungsten or other material(s) having a high atomic ("high Z") number. As the electrons 114 accelerate, they gain a substantial amount of kinetic energy, and upon striking the target material on the focal track 116, some of this kinetic energy is converted into electromagnetic waves of very high frequency, i.e., x-rays 120, shown in FIG. 1.

The focal track 116 is oriented so that emitted x-rays are directed toward an evacuated enclosure window 122. The evacuated enclosure window 122 is comprised of an x-ray transmissive material that is positioned within a port defined in a wall of the evacuated enclosure 104 at a point aligned with the focal track 116. An outer housing window 124 is disposed so as to be at least partially aligned with the evacuated enclosure window 122. The outer housing window 124 is similarly comprised of an x-ray transmissive material and is disposed in a port defined in a wall of the outer housing 102. The x-rays 120 that emanate from the evacuated enclosure 104 and pass through the outer housing window 124 may do so substantially as a conically diverging beam, the path of which is generally indicated at 126 in FIG. 1, and also in FIG. 2.

Additionally, the anode 108 includes a substrate 128, comprising graphite in some embodiments. The anode 108 is part of an anode assembly 130 that further includes an anode support assembly 132. The anode 108 is supported by the anode support assembly 132, which generally comprises a tuned bearing assembly 134 including a bearing housing 136, and a rotor sleeve 138. The tuned bearing assembly 134 is at least partially disposed in the evacuated enclosure 104. The bearing housing 136 is fixedly secured to a portion of the evacuated enclosure 104 such that the anode 108 is rotatably supported within the evacuated enclosure 104 by the tuned bearing assembly 134, such that the anode 108 is able to rotate with respect to the bearing housing 136. A stator 140 is disposed about the rotor sleeve 138 and utilizes rotational electromagnetic fields to cause the rotor sleeve 138 to rotate. The rotor sleeve 138 is attached to the anode 108, thereby providing the needed rotation of the anode 108 during operation of the x-ray tube 100.

While a specific x-ray tube 100 configuration has been disclosed, embodiments of the present invention can be practiced with x-ray tubes having different configurations from that described herein.

Figure 2:
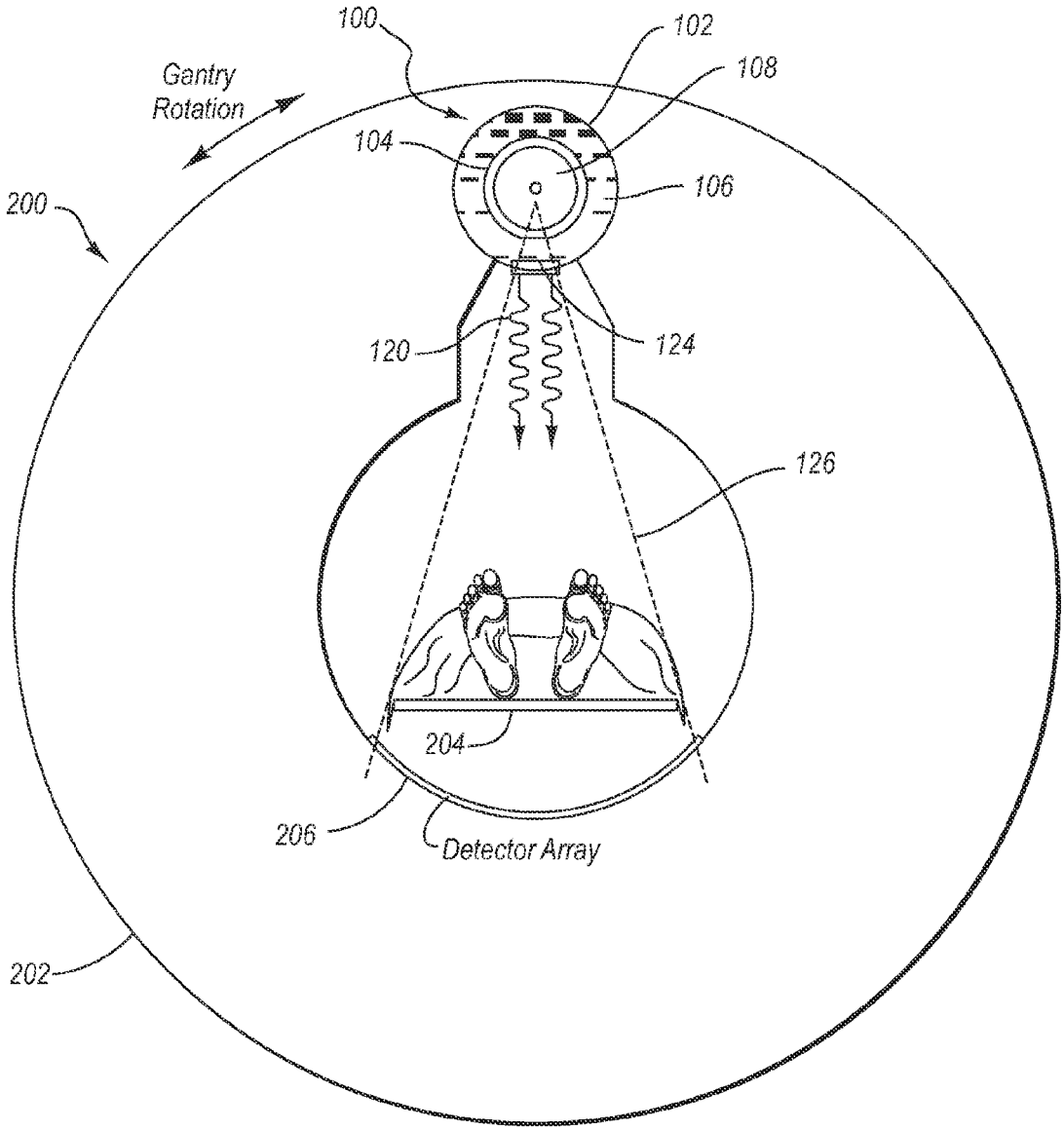
FIG. 2 is a depiction of one environment wherein an x-ray device including an embodiment of a tuned bearing assembly may be used.

Reference is now made to FIG. 2, which depicts one operating environment in which an x-ray tube having a tuned bearing assembly made in accordance with embodiments of the present invention can be utilized. FIG. 2 shows a CT scanner depicted at 200, which generally comprises a rotatable gantry 202 and a patient platform 204. An x-ray tube, such as the x-ray tube 100 depicted in FIG. 1, is shown mounted to the gantry 202 of the scanner 200. In operation, the gantry 202 rotates about a patient lying on the platform 204. The x-ray tube 100 is selectively energized during this rotation, thereby producing a beam of x-rays 120 that emanate from the tube as the x-ray beam path 126. After passing through the patient, the x-rays 120 are received by a detector array 206. The x-ray information received by the detector array 206 can be manipulated into images of internal portions of the patient's body to be used for medical evaluation and diagnostics.

In FIG. 2, the x-ray tube 100 of FIG. 1 is shown in cross-section and depicts the outer housing 102, the evacuated enclosure 104, and the anode 108 disposed therein, at which point the x-rays 120 in beam path 126 are produced.

As will be appreciated by those skilled in the art, the rotational speed of the gantry 202, and consequently that of the x-ray tube 100, can vary depending on the CT scanner 200 application. Furthermore, the intensity of the x-ray beam in beam path 126 required to obtain a desired image quality depends on the rotational speed of the x-ray tube 100 on the gantry 202. In particular, higher x-ray beam intensities are typically required for higher rotational speeds of the x-ray tube 100.

One manner for increasing the intensity of the x-ray beam in beam path 126 is to rotate the anode 108 at a relatively higher frequency and increase the density of the electrons 114 emitted by and accelerated from the cathode 110 to the anode 108. For instance, x-ray tubes on gantries rotating at about two RPMs may include an anode operating at approximately 110 Hz, while x-ray tubes on gantries rotating faster than two RPMs may require an anode with a relatively higher operating frequency, such as 150 Hz, to obtain images of similar quality. In some instances, however, characteristic resonant frequencies associated with components such as the bearing assembly can prevent operation of the anode at the desired operating frequency, whatever it may be.

II. Tuned Bearing Assembly

Figure 3A:
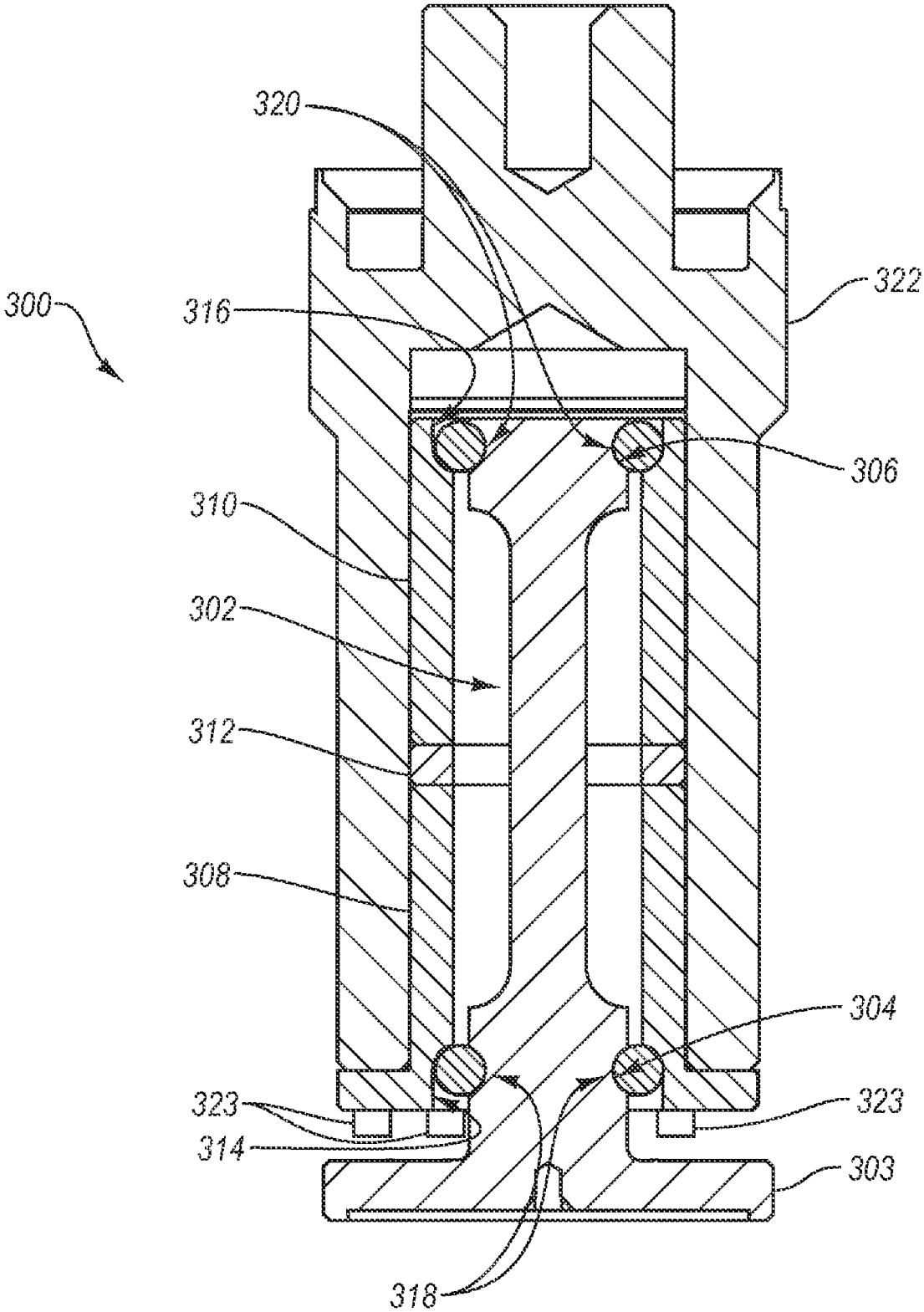
FIG. 3A is a cross-sectional view of an example of a tuned bearing assembly such as may be employed in the device of FIG. 1.
Figure 3B:
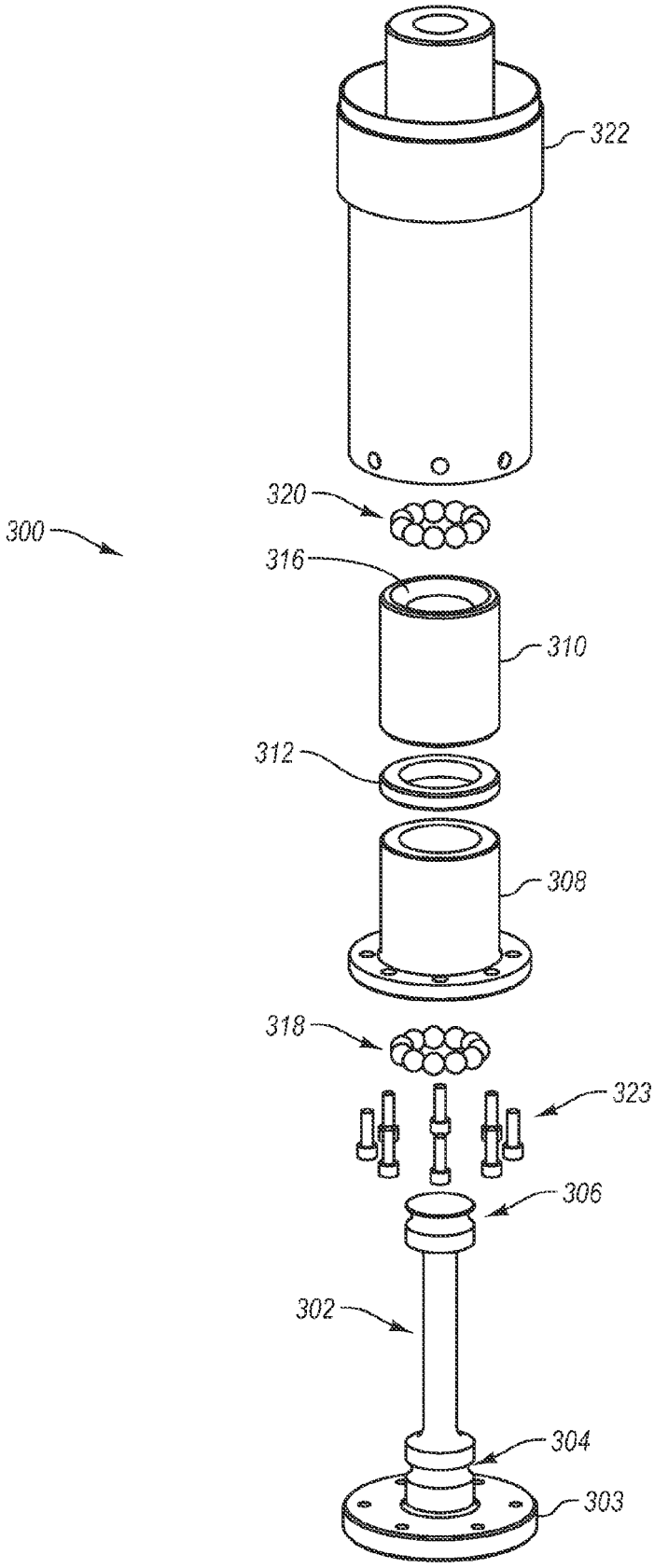
FIG. 3B is an exploded view of the tuned bearing assembly of FIG. 3A.

With additional reference to FIGS. 3A-3C, an embodiment of a tuned bearing assembly 300 is disclosed that has been tuned to exhibit one or more characteristic resonant frequencies at certain operating conditions in an anode assembly, such as the anode assembly 130 of FIG. 1. More particularly, a resonant frequency of the tuned bearing assembly 300 of FIGS. 3A-3B is tuned to approximately 130 Hz in some embodiments, enabling the tuned bearing assembly 300 to be implemented with an anode configured to operate at approximately 150 Hz. In other embodiments, however, the tuned bearing assembly 300 can be tuned to different resonant frequencies to enable operation at different operating frequencies. In general, the tuned bearing assembly 300 is tuned so that resonant frequencies occur at point(s) other than the desired operating frequency.

FIG. 3A discloses a cross-sectional view and FIG. 3B discloses an exploded view of the tuned bearing assembly 300. The tuned bearing assembly 300 of FIGS. 3A-3B may correspond to the tuned bearing assembly 134 of FIG. 1, for example.

As shown, the tuned bearing assembly 300 includes a shaft 302, which may comprise high-temperature tool steel, tungsten tool steel, molybdenum tool steel, ceramic, or other hard material. The shaft 302 includes a rotor hub 303 and defines a lower inner race 304 and upper inner race 306 disposed circumferentially about shaft 302. Lower and upper inner races 304 and 306, in turn, can include bearing surfaces that may be coated with a solid metal lubricant or other suitable lubricant.

Tuned bearing assembly 300 additionally includes lower bearing ring 308 and upper bearing ring 310 disposed about shaft 302 and separated by a spacer 312. While other spacer arrangements could be used, in the illustrated example an "O"-shaped spacer 312 is used. Alternately or additionally, a tubular-shaped spacer and/or "C"-shaped spacer can be used alone or in combination. Lower bearing ring 308 defines lower outer race 314 and upper bearing ring 310 defines upper outer race 316. Each of the lower outer race 314 and upper outer race 316 can include respective bearing surfaces that may be coated with a solid metal lubricant or other suitable lubricant. As in the case of shaft 302, lower and upper bearing rings 308 and 310, and spacer 312, may comprise high temperature tool steel or other suitable material(s). However, it will be appreciated that various other materials may be employed for the shaft 302, lower and upper bearing rings 308 and 310, and/or spacer 312 consistent with a desired application.

With more specific reference now to lower and upper bearing rings 308 and 310, and spacer 312, additional details are provided regarding the arrangement of such components with respect to shaft 302. In particular, lower bearing ring 308, upper bearing ring 310, and spacer 312, are disposed about shaft 302 so that lower outer race 314 and upper outer race 316 are substantially aligned with, respectively, lower inner race 304 and upper inner race 306 defined by shaft 302. In this way, lower outer race 314 and upper outer race 316 cooperate with, respectively, lower inner race 304 and upper inner race 306 to confine a lower ball set 318 and an upper ball set 320, respectively. Both lower ball set 318 and upper ball set 320 comprise respective pluralities of balls. In general, lower ball set 318 and upper ball set 320 cooperate to facilitate high-speed rotary motion of shaft 302, and thus of anode 108.

It will be appreciated that variables such as the number and diameter of balls in each of the lower ball set 318 and upper ball set 320 may be varied as required to suit a particular application. Further, in some embodiments of the invention, each of the balls in lower ball set 318 and upper ball set 320 are coated with a solid metal lubricant or other suitable material.

Directing continuing attention to FIGS. 3A and 3B, tuned bearing assembly 300 includes bearing housing 322 which serves to receive and securely retain lower and upper bearing rings 308 and 310, as well as shaft 302. In some embodiments, the bearing housing 322 defines an interior cavity substantially in the shape of a seamless cylinder and comprises a durable, high-strength metal or metal alloy, such as stainless steel or the like, that is suitable for use in high temperature x-ray tube operating environments.

In some embodiments, a plurality of bolts or other fasteners 323 serve to attach lower bearing ring 308 to bearing housing 322, thereby retaining upper bearing ring 310, spacer 312, and shaft 302 in position within bearing housing 322. It will be appreciated however, that various other fasteners may alternately or additionally be employed. Alternately, such fasteners may be eliminated and one or more of the aforementioned components attached to bearing housing 322 by way of processes including, but not limited to, welding and brazing.

The positioning of bearing rings 308 and 310, as well as shaft 302, within bearing housing 322 is facilitated by the spacer 312, which serves to, among other things, properly orient lower and upper bearing rings 308 and 310 with respect to shaft 302 and to properly orient lower outer race 314 and upper outer race 316 with respect to lower inner race 304 and upper inner race 306. Spacer 312, lower and upper bearing rings 308 and 310, and shaft 302 are securely retained in bearing housing 322 by way of fasteners 323 which secure lower bearing ring 308 to bearing housing 322, thereby substantially foreclosing axial movement of spacer 312 and lower and upper bearing rings 308 and 310.

The rotor hub 303 of the shaft 302 is configured to interconnect the shaft 302 with an anode, such as anode 108 of FIG. 1, and a rotor sleeve, such as rotor sleeve 138 of FIG. 1.

To that end, the rotor hub 303 can couple directly to the anode and rotor sleeve or indirectly via one or more intermediary components.

Directing continuing attention to FIGS. 3A and 3B, details are provided regarding various operational aspects of embodiments of the present invention. Note that while the following discussion is presented in the context of FIGS. 3A and 3B, such discussion is similarly germane to the various other embodiments contemplated hereby.

As mentioned above, a stator, such as stator 140 of FIG. 1, utilizes rotational electromagnetic fields to cause a rotor sleeve, such as rotor sleeve 138 (not shown), to rotate. Because the rotor sleeve (not shown) is connected to the shaft 302, which is also connected to the anode (not shown), the rotation of the rotor sleeve causes the shaft 302 and the anode to also rotate. In general, rotation of shaft 302 causes lower ball set 318 and upper ball set 320 to travel at high speed along, respectively, the races 304/314 and 306/316 cooperatively defined by shaft 302 and lower and upper bearing rings 308 and 310. The movement of the lower ball set 318 and upper ball set 320 along the races 304/314 and 306/316 cooperatively defined by shaft 302 and lower and upper bearing rings 308 and 310 allows the shaft 302 to rotate with respect to the lower and upper bearing rings 308 and 310 and the bearing housing 322.

Imbalances in the shaft 302, anode (not shown), and/or other rotating components coupled to the shaft 302 cause vibrations in the anode that may negatively affect x-ray tube operation and which increase as rotational frequency approaches a resonant frequency. The resonant frequency of the bearing assembly and/or anode depends on various factors, including the geometries of the moving and stationary components, the materials from which the components are made, the masses of the components, the centers of gravity of the components, the bulk moduli of the components, and the like.

In conventional x-ray tubes, the manufacturer determines one or more operating frequencies for the anode, based at least in part on the characteristic resonant frequency of the bearing assembly. In conventional x-ray tube designs, for instance, the bearing assembly may have a resonant frequency at 70-80 Hz. Upon determining the resonant frequency, the manufacturer may define one or more operating frequencies for the x-ray tube, such as a low-speed operating frequency below the resonant frequency and a high-speed operating frequency above the resonant frequency. The manufacturer selects the low-speed and high-speed operating frequencies such that prolonged operation at the resonant frequency is avoided.

In some instances, the materials and geometries of the bearing assembly and/or anode in a particular x-ray tube design result in a resonant frequency that may prevent operation at, or near, a desired operating frequency. For example, in the absence of a tuned bearing assembly 134 (of FIG. 1) or 300 according to embodiments of the invention, an x-ray tube design such as the x-ray tube 100 of FIG. 1 might have a conventional bearing assembly with a resonant frequency that prevents rotating the anode at a desired operating frequency of 150 Hz.

According to embodiments of the invention, however, the bearing assembly 300 is tuned to a resonant frequency that does not prohibit operation at, or near, the desired operating frequency. In contrast with typical processes that involve manufacturing a bearing assembly, determining its resonant frequency, and specifying one or more operating frequencies that avoid operation near the resonant frequency, some embodiments of the invention may involve selecting one or more desired operating frequencies and then tuning the bearing assembly to a resonant frequency that does not materially impair operation of the device at the desired operating frequency(ies).

As used herein, a device, assembly, or component is "tuned" if affirmative steps have been taken or implemented on one or more components of the device, assembly, or component to produce a physical configuration having one or more predetermined characteristic resonant frequencies. An x-ray device can be tuned by, e.g. adding material to or removing material from one or more moving or stationary components of the x-ray device; replacing one or more components comprising a first material with one or more components comprising a second material different from the first material; modifying the geometry of the one or more components of the x-ray device, or the like or any combination thereof The characteristic resonant frequency(ies) to which the x-ray device is tuned can be above, below, and/or between the desired operating frequency(ies). Further, embodiments of the invention include x-ray devices and/or other components that are tuned and installed as brand-new devices as well as x-ray devices and/or other components that are removed from a larger assembly, tuned, and re-installed after market.

In some embodiments, an operating frequency of 150 Hz is desired, and the tuned bearing assembly 300 is provided that has been tuned to a resonant frequency of approximately 130 Hz, allowing the anode to be rotated at a desired operating frequency of 150 Hz. Alternately, the tuned bearing assembly 300 can be tuned to different resonant frequencies to allow the anode to be rotated at different desired operating frequencies.

III. Example Shafts

In the embodiment of FIGS. 3A and 3B, tuning of the tuned bearing assembly 300 may be accomplished in various ways, such as by modifying the geometry of or removing material from a conventional shaft to produce a physical configuration for shaft 302 having a desired characteristic resonant frequency. For instance, conventional shafts are typically characterized by a single diameter along their entire length. In contrast, as shown in the example of FIG. 4A, the shaft 302 is characterized by a first diameter $D_1$ immediately above and below the lower inner race 304 and upper inner race 306, and by a second diameter $D_2$ along a section $S_1$ of the shaft 302 interposed between the lower inner race 304 and upper inner race 306. As shown, $D_2$ is smaller than $D_1$ and reduces the stiffness of the shaft 302 relative to more conventional shafts. The reduced stiffness of the shaft 302 relative to the conventional shaft shifts the resonant frequency of the tuned bearing assembly 300 relative to the resonant frequency of a conventional bearing assembly that includes the conventional shaft. More particularly, the reduced stiffness may shift, for example, the resonant frequency of the tuned bearing assembly 300 to a resonant frequency that is relatively lower than that of a conventional bearing assembly. Accordingly, the appropriate selection of geometric parameters of the shaft 302 allows the tuned bearing assembly 300 to be tuned to a resonant frequency that does not interfere with a desired operating frequency.

Figure 4B:
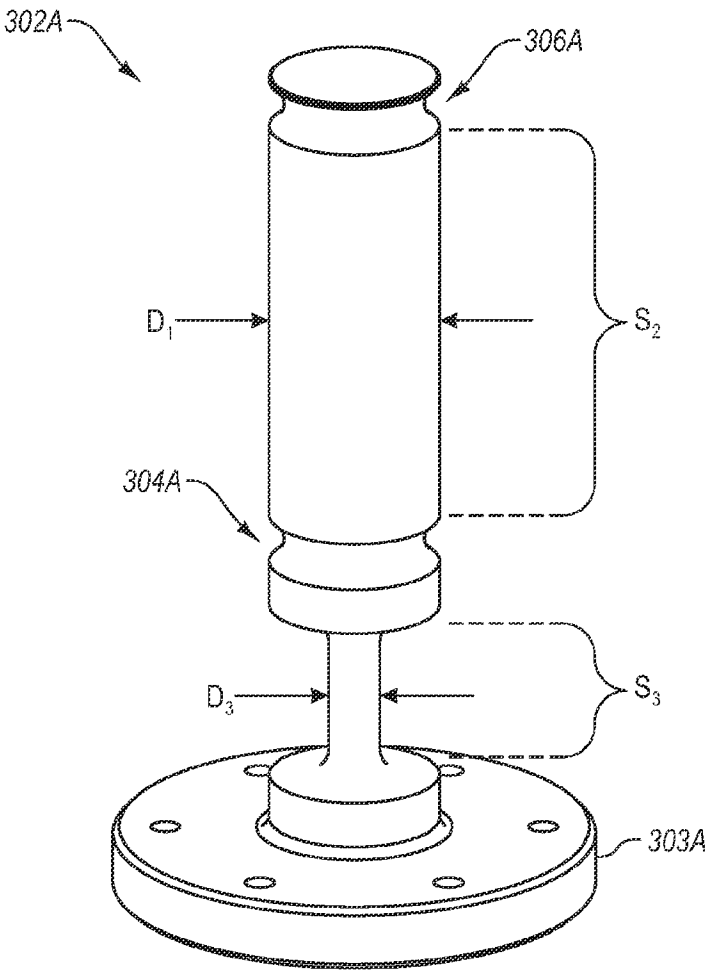
FIG. 4B is a perspective view of a second example bearing shaft.
Figure 4A:
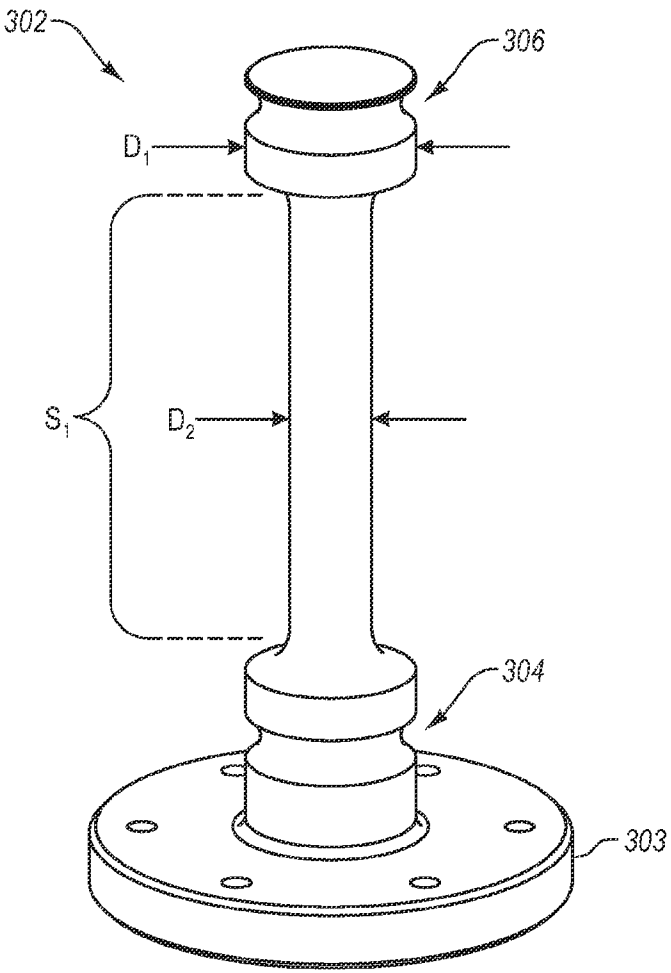
FIG. 4A is a perspective view of the example bearing shaft seen in FIGS. 3A and 3B.

FIG. 4B discloses a second example shaft 302A that can alternately be implemented to tune a bearing assembly to the same or a different resonant frequency than the shaft 302 of FIGS. 3A-4A. The second example shaft 302A includes a rotor hub 303A, lower inner race 304A, and upper inner race 306A. The shaft 302A is characterized by diameter $D_1$ along a section $S_2$ interposed between the lower and upper inner races 304A and 306A and by a diameter $D_3$ along a section $S_3$ interposed between the rotor hub 303A and lower inner race 304A. As shown, $D_3$ is smaller than $D_1$ and reduces the stiffness of the shaft 302A relative to more conventional shafts. The reduced stiffness of the shaft 302A may shift, for example, the resonant frequency of a tuned bearing assembly that includes shaft 302A to a resonant frequency that is relatively lower than that of a conventional bearing assembly.

In the examples of FIGS. 4A and 4B, tuning of the resonant frequency of a tuned bearing assembly is accomplished by modifying the geometry of a conventional shaft to produce a shaft 302 or 302A characterized by appropriate geometric parameters, such as appropriate diameters $D_1$-$D_3$ and section lengths $S_1$-$S_3$, for the shafts 302/302A. The geometric parameters can alternately or additionally include the length of the shaft 302/302A, the cross-sectional shape of the shaft 302/302A, or the like or any combination thereof.

Alternately or additionally, tuning can be accomplished by selecting appropriate materials for the shaft 302/302A. For example, the shaft 302/302A may comprise high-temperature tool steel in some embodiments, having a bulk modulus of approximately 35 million psi. Alternately, a shaft characterized by a single diameter substantially along the entire length of the shaft, formed from a material with a lower modulus of about 10 million, for example, could alternately be implemented to tune the resonant frequency of a tuned bearing assembly according to embodiments of the invention.

Alternately or additionally, tuning can be accomplished by modifying one or more components of the tuned bearing assembly 300 and/or in a corresponding anode assembly using one or more of the affirmative steps described below. For instance, the resonant frequency can be tuned by modifying one or more of the shaft 302, lower bearing ring 308, upper bearing ring 310, spacer 312, bearing housing 322, anode 108 (FIG. 1), substrate 128 (FIG. 1), rotor sleeve 138 (FIG. 1), or the like or any combination thereof.

IV. Experimental Results

Figure 5:
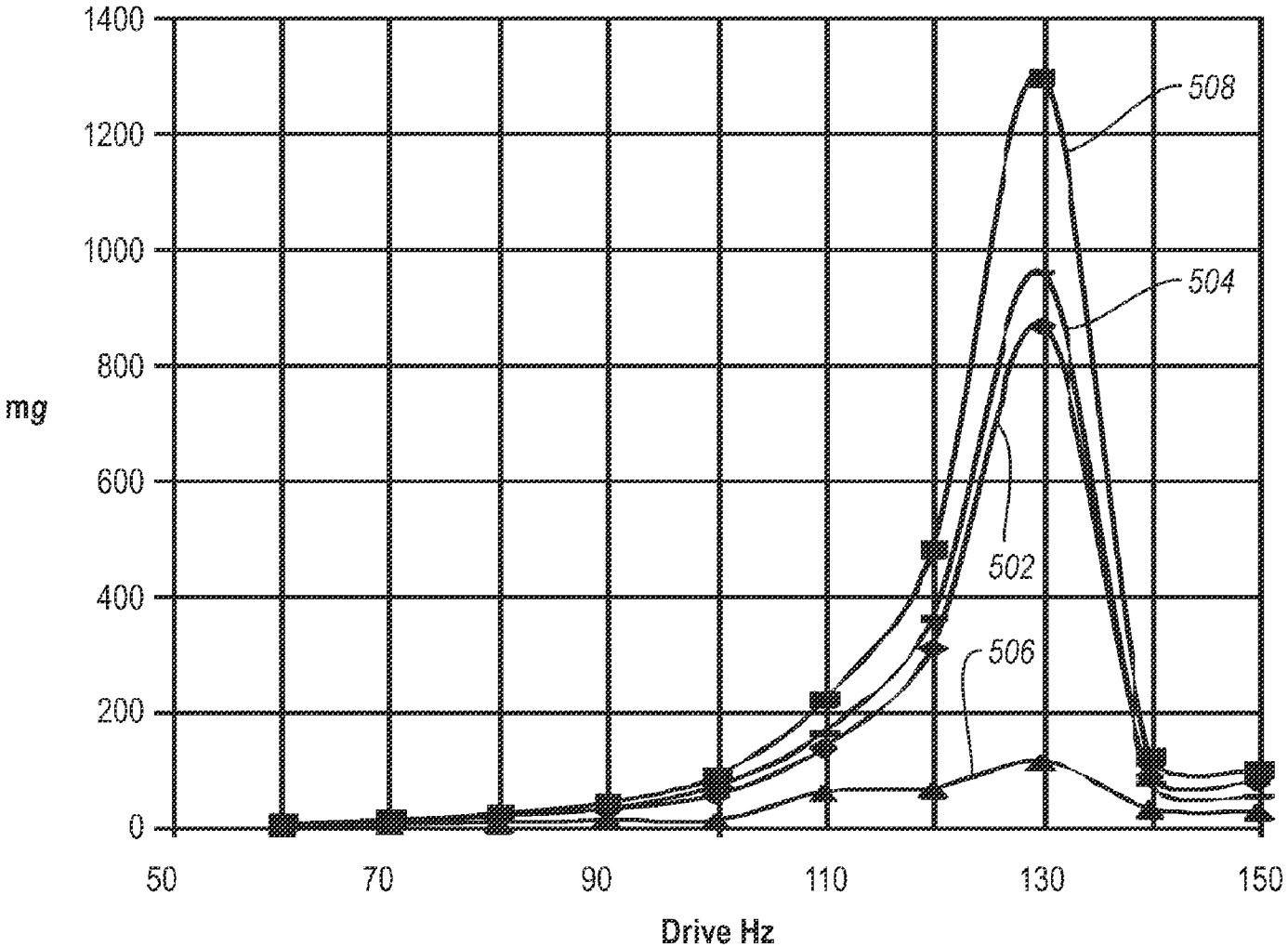
FIG. 5 is a graph depicting vibration magnitude versus drive frequency for one embodiment of a tuned bearing assembly.
Figure 6:
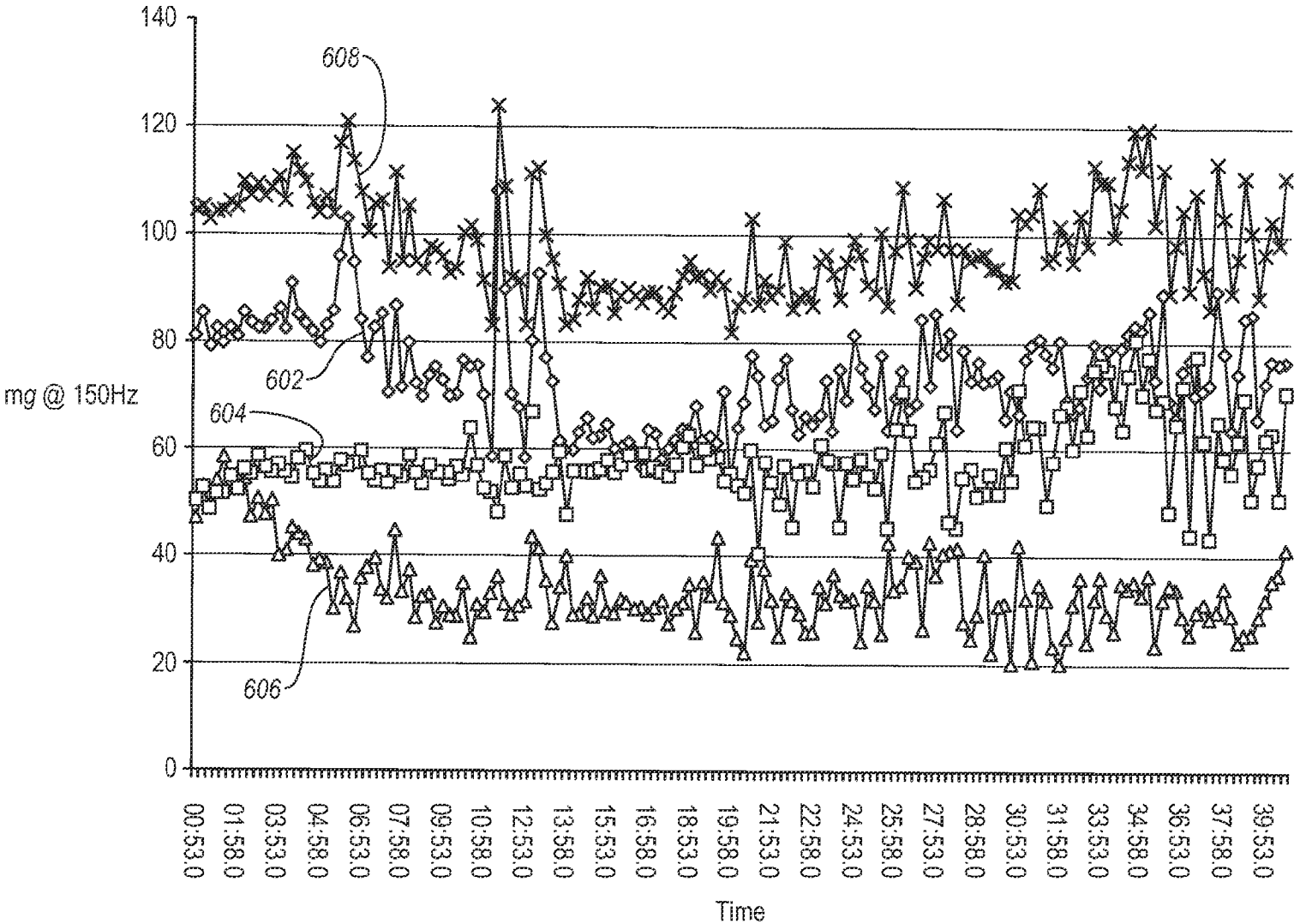
FIG. 6 is a graph depicting vibration magnitude versus time at constant operating frequency for the tuned bearing assembly embodiment of FIG. 5.

With reference now to FIGS. 5 and 6, test data are disclosed for one embodiment of a tuned bearing assembly implemented in an anode assembly. In particular, the test data for FIGS. 5 and 6 were obtained from a tuned bearing assembly including a shaft 302 comprising high-temperature tool steel characterized by a diameter $D_1$ equal to about 0.79 inches, a diameter $D_2$ equal to about 0.38 inches, and a section $S_1$ equal to about 2.11 inches in length. The tuned bearing assembly was tuned to allow operation at a 150 Hz operating frequency.

FIG. 5 shows the vibrations measured in the tuned bearing assembly while implemented in an anode assembly as a function of drive frequency (Hz). The units of the vibrations are in mgs, e.g. $1\times10^{-3}$ g, where 1 g=9.80665 m/s$^2$. Accordingly, "vibration" of the tuned bearing assembly refers to acceleration of the tuned bearing assembly. Measurements were taken in three dimensions, i.e., along the x-axis, y-axis, and z-axis (see FIG. 1 for the reference axes), to generate data represented by curves 502, 504, and 506, respectively. Curve 508 represents the square root of the sum of the squares of the data for curves 502, 504, and 506, and thus defines a "total vibration" of the shaft over all three dimensions. More generally, the square root of the sum of the squares is often used when measuring vibrations in multiple dimensions to provide a single quantity representative of vibrations in all dimensions at a given point in time.

As can be seen from the graph of FIG. 5, the resonant frequency of the tuned bearing assembly is approximately 130 Hz. Accordingly, the magnitude of the vibrations in the tuned bearing assembly peak at approximately 130 Hz. However, the magnitude of the vibrations then drop to acceptable levels at the desired operating frequency of 150 Hz.

FIG. 6 shows the vibrations measured in the tuned bearing assembly implemented in the anode assembly at a constant operating frequency of 150 Hz for a period of time of approximately 40 minutes. During the period of time, a linear energy input was applied to heat the anode of the anode assembly from about 25° C. at 53 seconds to a maximum operating temperature of about 1000° C. at approximately 25 minutes. The energy input was removed and the anode cooled back to 25° C. by about 39 minutes and 53 seconds. The anode was heated to its maximum operating temperature while rotated at constant operating frequency of 150 Hz to ensure proper operation of the tune bearing assembly at various temperature conditions and the 150 Hz operating frequency. Similar to FIG. 5, vibration magnitude measurements were taken along the x-axis, y-axis, and z-axis of the shaft to generate data represented by curves 602, 604, and 606, and the measured data was then used to derive curve 608, which is representative of the square root of the sum of the squares of the data for curves 602, 604, and 606. The data of FIG. 6 demonstrates that the tuned bearing assembly according to embodiments of the invention was well-behaved across varying temperatures, insofar as the total vibration—represented by curve 608—of the tuned bearing assembly stayed within a narrow range of variation, e.g. between 80-120 mg, during the 40-minute long heating and cooling process, and the range of variation was below maximum acceptable vibration magnitude.

V. Method of Tuning

Figure 7:
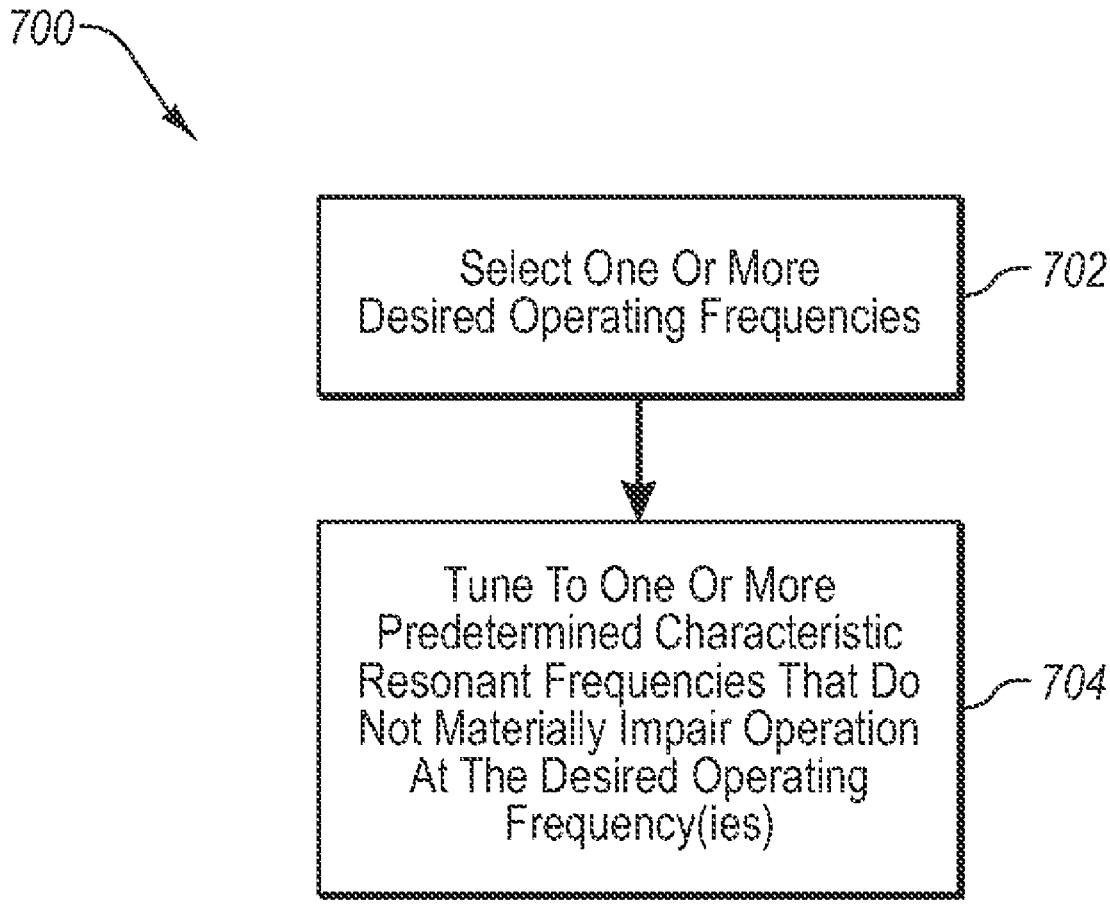
FIG. 7 illustrates a flow chart of an example method for manufacturing a tuned component.

With additional reference to FIG. 7, one embodiment of a method 700 for manufacturing a tuned component, device, or assembly is disclosed. Although the method 700 will be discussed in the context of manufacturing tuned bearing assembly 300, the method 700 can alternately or additionally be implemented to manufacture an x-ray device 100 having one or more tuned components, to manufacture a tuned shaft 302, and/or to manufacture any other tuned component, device, or assembly.

The method 700 begins by selecting 702 one or more desired operating frequencies for a bearing assembly. The desired operating frequency(ies) of the bearing assembly may depend on, for example, an x-ray intensity that an anode rotatably supported by the bearing assembly is desired to produce. In some instances, the bearing assembly may already exist in a default configuration having one or more characteristic resonant frequencies that would materially impair operation of the bearing assembly at the desired operating frequency. In some embodiments, the desired operating frequency is 150 Hz and the default configuration of the bearing assembly has a characteristic resonant frequency that prevents operation at 150 Hz.

After the desired operating frequency(ies) has been selected, the method 700 continues by tuning 704 the bearing assembly to one or more predetermined characteristic resonant frequencies that do not materially impair operation of the bearing assembly at the desired operating frequency(ies). In the embodiments of FIGS. 4A and 4B, for example, tuning the bearing assembly comprises modifying the geometry of and/or removing material from more conventional shafts to form tuned shafts 302, 302A, which can be implemented in tuned bearing assembly 300.

More generally, tuning 704 a device, assembly, or component may include taking one or more affirmative steps to a produce a device, assembly, or component with a physical configuration having the one or more predetermined characteristic resonant frequencies that do not prevent operation at the desired operating frequency(ies). The one or more affirmative steps can be taken on one or more moving or stationary components of the device, assembly, or component and can include, for example: adding material to one or more components, removing material from one or more components, modifying the geometry of one or more components, replacing one or more components made from a first material with one or more components made from a second material different from the first material, changing the mass of one or more components, changing the center of gravity of one or more components, or the like or any combination thereof.

In some embodiments of the invention, producing the desired physical configuration, e.g. the physical configuration having the one or more predetermined characteristic resonant frequencies, involves selecting one or more components of the device, assembly, or component to modify using the one or more affirmative steps and calculating, using the desired operating frequency(ies), a potential modification to make on the one or more components that will produce the desired physical configuration. Alternately or additionally, producing the desired physical configuration can involve an iterative process of modifying the one or more components and then testing the device, assembly or component until one or more characteristic resonant frequencies of the device, assembly or component reach the predetermined characteristic resonant frequencies or are within a predetermined range of the predetermined characteristic resonant frequencies.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An x-ray tube, comprising:

an anode configured to be rotated at an operating frequency; and a bearing assembly configured to rotatably support the anode and tuned to a resonant frequency that is different than the operating frequency, the bearing assembly comprising:

a shaft to which the anode is coupled;

lower and upper bearing rings which cooperate with the shaft to define lower and upper races;

a spacer interposed between the lower and upper bearing rings;

a lower ball set disposed in the lower race and an upper ball set disposed in the upper race; and a bearing housing configured to receive the lower and upper bearing rings, the lower and upper ball sets, the spacer, and a portion of the shaft.

2. The x-ray tube of claim 1, wherein one or more of the following bearing assembly components is a tuned component: the shaft, the lower bearing ring, the upper bearing ring, the spacer, or the bearing housing.

3. The x-ray tube of claim 2, wherein the shaft is a tuned component and is characterized by a first diameter immediately above and below the lower race and the upper race, and a second diameter along a section of the shaft interposed between the lower race and the upper race.

4. The x-ray tube of claim 3, wherein the first diameter is approximately 0.79 inches, the second diameter is approximately 0.38 inches, and the section of the shaft interposed between the lower race and upper race is approximately 2.11 inches long.

5. The x-ray tube of claim 2, wherein the shaft is a tuned component and is characterized by a first diameter along a first section of the shaft interposed between the lower race and the upper race, and a second diameter along a second section of the shaft interposed between the lower race and a rotor hub disposed at one end of the shaft, the first diameter being greater than the second diameter.

6. The x-ray tube of claim 1, wherein the operating frequency is approximately 150 Hz and the resonant frequency is approximately 130 Hz.

7. An x-ray tube, comprising:

an evacuated enclosure;

an electron source disposed within the evacuated enclosure; and an anode assembly at least partially disposed in the evacuated enclosure and tuned to a resonant frequency different than an operating frequency, the anode assembly including:

an anode positioned so as to receive electrons emitted by the electron source;

a bearing assembly rotatably supporting the anode, the bearing assembly comprising:

a shaft coupled to the rotor sleeve and the anode;

lower and upper bearing rings which cooperate with the shaft to define lower and upper races;

a spacer interposed between the lower and upper bearing rings;

a lower ball set disposed in the lower race and an upper ball set disposed in the upper race; and a bearing housing fixedly secured to the evacuated enclosure and receiving the lower and upper bearing rings, the lower and upper ball sets, the spacer, and a portion of the shaft; and a rotor sleeve to which the anode and a portion of the bearing assembly are coupled, the rotor sleeve being responsive to applied electromagnetic fields such that a rotational motion is imparted to the anode.

8. The x-ray tube of claim 7, wherein one or more of the following components is a tuned component: the anode, the rotor sleeve, the shaft, the lower bearing ring, the upper bearing ring, or the bearing housing.

9. The x-ray tube of claim 8, wherein the shaft is a tuned component and is characterized by a first diameter immediately above and below the lower race and the upper race, and a second diameter along a section of the shaft interposed between the lower race and the upper race, the second diameter being smaller than the first diameter.

10. The x-ray tube of claim 8, wherein the shaft is a tuned component and is characterized by a first diameter along a first section of the shaft interposed between the lower race and the upper race, and a second diameter along a second section of the shaft interposed between the lower race and a rotor hub disposed at one end of the shaft for coupling the shaft to the rotor sleeve, the first diameter being greater than the second diameter.

11. The x-ray tube of claim 7, wherein the operating frequency is approximately 150 Hz and the resonant frequency is approximately 130 Hz.

12. A method of manufacturing a bearing assembly, comprising:

selecting a desired operating frequency for the bearing assembly; and tuning the bearing assembly to a predetermined resonant frequency that does not materially impair operation of the bearing assembly at the desired operating frequency, the tuning the bearing assembly comprising one or more of:

adding material to one or more components of the bearing assembly;

removing material from one or more components of the bearing assembly;

replacing one or more bearing assembly components comprising a first material with one or more bearing assembly components comprising a second material different from the first material;

modifying the geometry of one or more components of the bearing assembly;

changing the mass of one or more components of the bearing assembly; or changing the center of gravity of one or more components of the bearing assembly.

13. The method of claim 12, wherein the desired operating frequency is approximately 150 Hz, and the predetermined resonant frequency is approximately 130 Hz.

14. The method of claim 12, wherein tuning the bearing assembly involves an iterative process of modifying one or more components of the bearing assembly and testing the bearing assembly until a characteristic resonant frequency of the bearing assembly reaches the predetermined resonant frequency or is within a predetermined range of the predetermined resonant frequency.

15. The method of claim 12, wherein prior to tuning the bearing assembly to the predetermined resonant frequency, the bearing assembly has one or more characteristic resonant frequencies that would materially impair operation of the bearing assembly at the desired operating frequency.

16. The method of claim 12, wherein tuning the bearing assembly comprises modifying the geometry of a shaft of the bearing assembly to form a tuned shaft.

17. The method of claim 12, wherein tuning the bearing assembly to the predetermined resonant frequency comprises taking one or more affirmative steps on the bearing assembly to produce a bearing assembly physical configuration having the predetermined resonant frequency.

18. An x-ray tube, comprising:

an anode configured to be rotated at an operating frequency; and a bearing assembly configured to rotatably support the anode via a shaft that is tuned to a resonant frequency that is different than the operating frequency, wherein the shaft has a first diameter immediately above a lower race and below an upper race, and a second diameter along a section of the shaft interposed between the lower race and the upper race, the first diameter being different from the second diameter.

19. An x-ray tube, comprising:

an anode configured to be rotated at an operating frequency; and a bearing assembly configured to rotatably support the anode via a shaft that is tuned to a resonant frequency that is different than the operating frequency, wherein the shaft has a first diameter along a first section of the shaft interposed between a lower race and an upper race, and a second diameter along a second section of the shaft interposed between the lower race and a rotor hub disposed at one end of the shaft, the first diameter being greater than the second diameter.

* * * * *